US006370731B1

(12) United States Patent
Carter

(10) Patent No.: US 6,370,731 B1
(45) Date of Patent: Apr. 16, 2002

(54) VACUUM DUSTING ATTACHMENT DEVICE

(76) Inventor: William B. Carter, 7729 Sabre Dr., Knoxville, TN (US) 37919-7124

( * ) Notice: Subject to any disclaimer, the term of this patent is extended or adjusted under 35 U.S.C. 154(b) by 0 days.

(21) Appl. No.: 09/483,126

(22) Filed: Jan. 17, 2000

(51) Int. Cl.[7] ..... A47L 9/02
(52) U.S. Cl. ..... 15/393; 15/396; 15/415.1
(58) Field of Search ..... 15/393, 396, 234, 15/415.1

(56) References Cited

U.S. PATENT DOCUMENTS

| | | | | | |
|---|---|---|---|---|---|
| 1,040,176 | A | * | 10/1912 | Eichele | 15/234 |
| 1,902,534 | A | * | 3/1933 | Wielatz | 15/396 |
| 2,198,339 | A | * | 4/1940 | Hamilton | 15/396 |
| 2,206,738 | A | * | 7/1940 | Brock et al. | 15/395 |
| 2,214,989 | A | * | 9/1940 | Brand | 15/234 |
| 2,243,120 | A | * | 5/1941 | Pollitt | 15/396 |
| 2,606,338 | A | * | 8/1952 | De Lorenzo | 15/395 |
| 4,198,727 | A | * | 4/1980 | Farmer | 15/396 |
| 4,972,541 | A | * | 11/1990 | Smith, Jr. | 15/234 |
| 5,074,008 | A | * | 12/1991 | Palomino, Jr. | 15/393 |
| 5,115,765 | A | * | 5/1992 | El-Omary | 15/346 |
| 5,123,142 | A | * | 6/1992 | MIller | 15/393 |
| 5,652,997 | A | * | 8/1997 | Na | 15/373 |
| 5,692,263 | A | * | 12/1997 | Sorenson | 15/396 |

FOREIGN PATENT DOCUMENTS

| | | | | | |
|---|---|---|---|---|---|
| FR | 4.440.558 | A | * | 4/1965 | 15/393 |

* cited by examiner

*Primary Examiner*—Robert J. Warden, Sr.
*Assistant Examiner*—Theresa T. Snider
(74) *Attorney, Agent, or Firm*—M. Alex Brown, Patent Attorney

(57) ABSTRACT

A dusting attachment device is disclosed for use in interaction with a line or connection hose of a suction or blowing type cleaning system. The invention is provided with a core unit with base and apex ends and three lengthwise oriented portions. The core has a cone, truncated cone, pyramid or truncated pyramid shape, in preferred embodiments. The invention's core is provided with a selected functional patterning of air apertures which extend through the core's outboard and inboard surfacing and communicate with the core's central air channel. As patterned, each of the air apertures have an interstitial space portion between each other, which sets forth air apertures and interstitial spaces on the outboard and inboard surfaces of the core's apex end and first two portions. The apertures are also arranged in sequence and position in relation to one another. A feathering system is provided having a number of individual feather components, where each of the feather components are attached to the interstitial spaces of the core's outboard surfacing. The invention is fabricated so that each feather component is dimensioned to be part of an overall configuration shape of the feathering system; and the core unit is fabricated from malleable, formable or positionable material or fabric having position integrity. The third portion provides the end opening of the air channel and is positioned/installed in interaction with a line of a cleaning system.

20 Claims, 13 Drawing Sheets

VACUUM DUSTING ATTACHMENT DEVICE

BACKGROUND OF THE INVENTION

1. Field of the Invention

The present invention relates to apparatus, method and system for providing a dusting attachment device, which is installed on a suction-type vacuum cleaner and functions to equalize air flow current while providing a favorable dusting or dislodging surface.

2. Background Information

Those references found in the process of a U.S. patent search, having some relation in the prior art to technology attempting to address dusting and cleaning functions, or marshalling of debris in relation to another cleaning assembly, of those references found, include United States Patents to Miller, U.S. Pat. No. 5,123,142; Hamilton, U.S. Pat. No. 2,198,339; Palomino, Jr., U.S. Pat. No. 5,074,008; Smith, Jr., U.S. Pat. No. 4,972,541; Farmer, U.S. Pat. No. 4,198,727; Sorenson, U.S. Pat. No. 5,692,263; El Omary, U.S. Pat. No. 5,115,765; and Na, U.S. Pat. No. 5,652,997.

Miller '142 discloses a Vacuum Operated Cleaner Attachment. Disclosed therein is a cleaner attachment for use with a common vacuum cleaner having a group of duck feathers which are longitudinally arranged around half of its cylindrical tube. Miller's tube has the same cross-section throughout its entire length. The tube has a side wall and an end wall, and communicates, as claimed, with a vacuum source through its hollow internal passageway. This reference teaches a special securing means in the form of a wire overlying the quills of its feathers and heat shrinkable material overlying the wire holding the feathers. The feathers are each secured at one basic location, only, on the tube, and face the same longitudinal direction. A mustering of openings, having no discernible or disclosed pattern are provided through the side wall of Miller's tube member beneath the one-directional feathers. Specifically, as disclosed, illustrated or claimed; Miller's tube-side wall openings are beneath the longitudinal feathers and are said to be directing air flow laterally through the feathers, where the openings communicate with the passageway within the tube and serve to distribute generally equalized lateral air flow directly through the area of the feathers into the portion of the tube beyond the points of attachment of the feathers.

Miller does not illustrate or claim a conical or pyramidal central core, a functional and discernible patterning of air channels, or the multiple and diverse connection sites of feathering members at interstitial spaces between air channels throughout the majority of perimeter or circumferential space available on a core member. Nor does Miller set forth any of the configurational arrays of feathering set forth by the present invention; only one longitudinal arrangement of straight duck feathers secured at one basic location only; and dimensioned at basically one quill diameter and length of feather.

Palomino '008 discloses a Dust Mop Attachment For Vacuum Cleaners. In its broadest teaching Palomino discloses and claims a mop attachment to a nozzle of a vacuum cleaner, having no feathering, and no array or patterning, or plurality, of air channels between or amongst which feathering or a reasonable equivalent is attached. Rather, only, a mop having a frame member, a mop element with one centrally located hole for receiving a vacuum cleaner nozzle, and means for detachable securing the mop element to its frame member and for detachably securing the cleaner nozzle to the mop element. elements of the mop simply surround one basic air hole, in vast difference with the present invention, where a diversity and plurality of feather members are attached to interstitial areas between a plurality and array of air channels deployed about a cone-like or pyramid-like core unit.

The Hamilton '339 reference issued in 1940 discloses simply a "brush," especially adapted for cleaning foreign matter from radiators, Venetian blinds and other such devices with parts difficult to reach for cleaning. The "brush" is disclosed as being adaptable to a vacuum cleaner, and shaped in its main body for working between 'slats' of Venetian blinds or within and about the various tubes of a radiator, to loosen or dislodge, with the force and structure of a "brush," the dirt and foreign matter encountered, for vacuum cleaning removal. For this purpose, Hamilton's sole disclosure and claim address: "A brush comprising an elongated hollow body having one end [its connecting end] reduced to form a neck for insertion into a suction hose and provided at the opposite end with an arcuate curvature" having an opening cut on a bias. Hamilton's hollow body is "of substantially elliptical shape in cross section to provide opposed edges and opposed convex walls," in almost opposite distinction to the structure of the present invention. The 'Brush' of this reference is further provided with openings on the brush body which are disclosed as essentially being two lengthwise oriented lines of openings, one on each of the body's two opposed convex walls, as shown in cross-section in Hamilton's FIG. 2 drawing. Also, Hamilton discloses and claims "tufts of bristles secured on the edges and opposed convex walls of the [brush] body;" rather than a circumferentially oriented array and patterning of a number of air apertures on each arced or planar surface, with an interstitially attached number of feathering components about all such areas of a conical or pyramidal core unit. Hamilton does not teach a plurality of air channels in a diverse or patterned array about its available spacing; and does not teach the placement of feathering, or even its own 'brush bristles,' in areas between such air apertures or holes (interstitial areas) on either of the two opposing elliptical faces that Hamilton does teach.

Smith '541 discloses a feather duster having its own built-in fan assembly, dust catching assembly and turbulence-inducing gap. Disclosed is a "multiplicity of feathers" each of which is attached at one end, only, of the device, pointing in one direction relative to the device; and without a positional or functional relationship to a patterning, array and plurality of air apertures about a core unit attachment, as in the case of the present invention.

The remaining references found appear to be of less significance than those discussed previously herein. They pertain to a baseboard duster for vacuum cleaners ('727); a delicate dusting vacuum tool having outer holes sunk within grooves and no feathering components or reasonable structural similarity or equivalent ('263); a flea blower vacuum for pets ('765); and an auxiliary suction tool for use in a vacuum cleaner ('997).

None of the references found in the prior art specifically illustrate or disclose the vacuum dusting attachment device of the present invention. Nor is the invention obvious in view of any of the prior art references listed. In addition, all of the relevant prior art heretofore known suffer from a number of disadvantages.

None of the prior art references adequately address the problem of marshaling dust and particle debris to a central body for suction and evacuation.

Also, the prior art has not provided an accurate and flexible feathering arrangement for efficiently dislodging dust and like particles, but relied upon hard or substantially inflexible bristles or one-direction, hard, feathering of one basic length and dimensioning, secured to point in only one direction, and secured at one location only or at limited locations on inferior designed core bodies.

Additionally, none of the prior art devices in this area of technology have employed any configuration, or dimensioning or sizing, of feathering, except those of conventional dusters utilized in the art without vacuum cleaning devices. Nor has the prior art addressed the utilization of conical or pyramidal core units, uniformly tapered from their base end to their apex end, providing a diverse patterning of air channels over about two-thirds (⅔'s) of its length, and at the tip area, or providing a plurality of feather attachment sites at the spaces between each of a number of air channels on all faces of a core unit, for greater equalization of air currents and their effects more closely to a work site being dusted or contacted for dislodging particles therat.

Further, none of the prior art devices appear to have a central body or core which is constructed of malleable and flexible soft metal, alloy, polymer or composite; and which can be dimensionally adjusted by virtue of such construction materials, while retaining structural and positional integrity.

These and other disadvantages, structurally and functionally, of the prior art, will become apparent in reviewing the remainder of the present specification, claims and drawings.

Accordingly, it is an object of the present invention to provide a substantially improved dusting attachment device for use in interaction with a vacuum cleaner, vacuum/suction cleaning means or system, or blowing cleaner, or vacuum, system; having improved air-equalizing and particle or dust dislodging features.

In this regard it is a further object of the present invention to provide an improved conical or pyramidally configured and shaped core unit, tapering from its base end to its apex end and having improved positioning, patterning and dimensioning of air apertures; and improved feathering means, of a number of novel and improved configurations and dimensioning, with individual feather components attached to to its novel core unit at locations between the air apertures throughout about two-thirds (⅔'s) of the core's available overall spacing or length.

It is yet a further object of the present invention to provide a dusting attachment device having a core unit which is fabricated of soft, malleable and flexible metals, metal alloys, polymers, composite wood or metal-polymer materials, and positionable fabric material; each having positional integrity as adjusted or fitted; for ease in fitting, and size or dimensioning adjustment, in interaction with various cleaning system lines; and for simplicity and cost effectiveness in manufacturing and constructing the present invention. Yet a further related object, in this regard, is to provide cost effectiveness in the manufacturing process in utilizing many more diverse types and sizes of feathering and the convenient, efficient and inexpensive means of attaching the invention's feather components in spacing between its air apertures by means of utilizing a diverse number of conventionally available glues, cements, polymers, caulks or like fluids.

It will, therefore, be understood that substantial and distinguishable structural and functional advantages are realized in the present invention over the prior art devices; and that the present invention's simplicity and diversity of structure, diverse utility, and broad functional applications serve as important bases of novelty and distinction in this regard.

SUMMARY OF THE INVENTION

The foregoing and other objects of the invention can be achieved with the present invention, device, system and method which is a dusting attachment device for use in interaction with a cleaning system having a suction or blowing means and an line in communication therewith. The invention is provided with a core unit having apex and base ends and first, second and third portions therebetween, respectively, from the apex end to the base end, the core unit defining therewithin an air channel extending from the apex end, where it is enclosed thereat, to the base end, where it extends therethrough, and defining by virtue thereof an inboard surface adjacent to the air channel and an outboard surface spaced from the inboard surface. The apex end and the first and second portions of the core unit further define, in a patterning throughout a plurality of air apertures, extending through the outboard and inboard surfaces, and defining solid interstitial space portions between each of the air apertures on the apex end and on each of the outboard and inboard surfaces.

The invention is further provided with feathering means being fixedly attached to the solid interstitial space portions of the outboard surface of the apex end and the first and second portions of the core unit, the feathering means defining a configurational shape.

The dusting attachment can, therefore, be installed along the air channel of the base end, at the third portion of the core unit, in interaction with a line in communication with a suction or blowing means of a cleaning system, for functional use in equalizing the suction or blowing area between the apex end, the second portion and adjacent areas of the core unit, while dislodging dirt, dust, particles or debris in a work area.

REFERENCE NUMBERS

Figure 1:
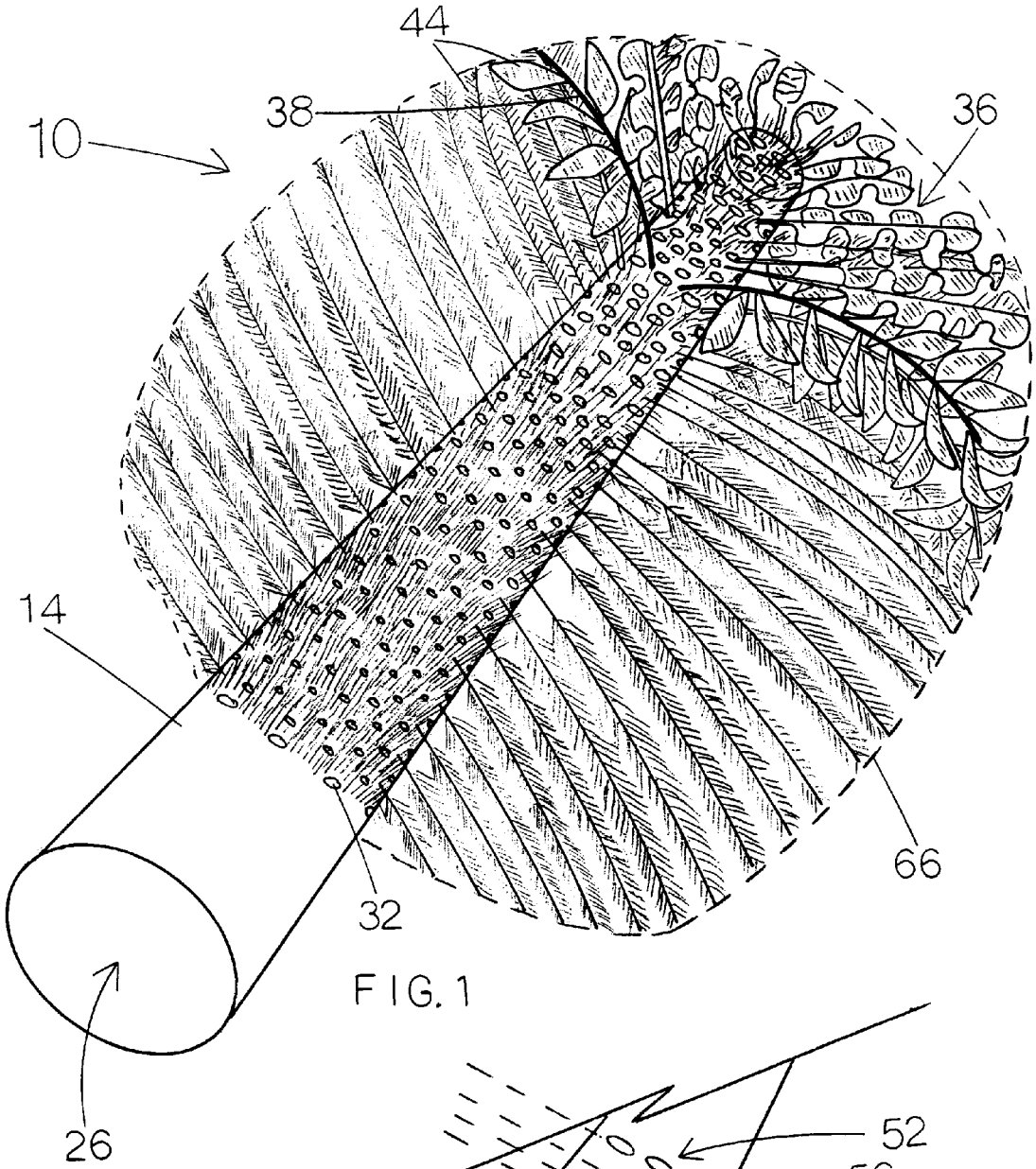
FIG. 1 is a perspective view of one preferred embodiment of the novel dusting attachment device of the present invention.
Figure 2:
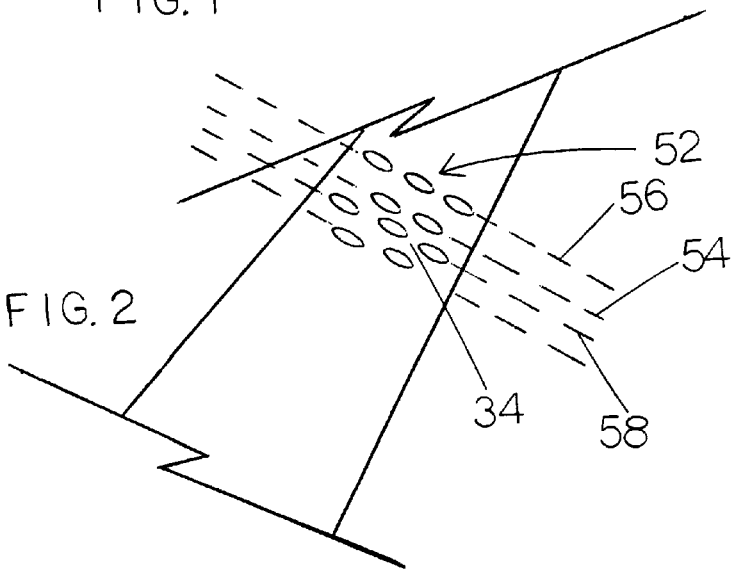
FIG. 2 is a partial side view of the core unit of the invention in one preferred embodiment thereof, illustrating a patterning of the air apertures of the invention.

Vacuum and blower dusting attachment device, referred to herein as DAD (Dusting Attachment Device)
Cleaning system line (conventional)
Core unit
apex end of (14)
base end of (14)
first portion of (14)
second portion of (14)
third portion of (14)
air channel
inboard surface of (14)
outboard surface of (14)
air apertures of (14)
solid interstitial spaces of (14)
feathering system
individual feather components of (36)
lower central quill portion of (38)
upper rachis portion of (38)
vane portion of (38)
cone or truncated cone configuration of (14)
pyramidal or truncated pyramidal configuration of (14)
pyramidal faces of (48)
alternating patterning of (32)
first line of air apertures of (52)
upper adjacent line of air apertures of (52)
lower adjacent line of air apertures of (52)
space-slot patterning of apertures (52)
alternating lines of apertures of (60)
substantially triangular positional orientation of apertures (32) of lines (62)
generally circular configuration and contour of feathering (36)
generally arcuate configuration
generally elliptical configuration and contour of feathering (36)
generally conical or frustum conical configuration and contour of feathering (36)
generally pyramidal or frustum pyramidal-like configuration and contour of feathering (36)
base portion of (70)
apex portion of (70)
base portion of (72)
vertex portion of (72)
pyramidally planed face portion of (72)
generally curved reverse-tapered configuration of feathering (36)
generally linear reverse-tapered configuration of feathering (36)
rhombus-like reverse taper configuration of feathering (36)

DETAILED DESCRIPTION OF THE PREFERRED EMBODIMENTS OF THE INVENTION

The following description of the preferred embodiments of the concepts and teaching of this present invention is made in reference to the accompanying drawing figures which constitute preselected illustrated examples of the structural and functional elements of the present invention, among many other examples existing within the scope and spirit of the present invention.

Referring now to the drawings; FIGS. 1, 2, 3, 3A, 3B, 3C, 4, 4A, 4B, 5, 6, 6A, 6B, 7, 8, 9, 10, 11A, 11B, 12, and 13, thereof, there is shown a vacuum and blower dusting and dislodging attachment device 10, of the present invention, referred to herein as the DAD 10 (Dusting Attachment Device).

The DAD 10 is utilized in interaction with a cleaning system line 12, such as a suction-type vacuum cleaner or blower-cleaning system, each having an extended, exposed or extendable hose or communication line; such as those, and related systems, conventionally available.

The DAD 10 is provided with a core unit 14, having an apex end 16 and base end 18; and also having first, second and third portions 20, 22 and 24, respectively. The portions 20, 22, and 24 are lengthwise-oriented spacial portions extending, respectively, between the apex end 16 and the base end 18. The core 14 is also provided with the air channel 26, shown by example in FIGS. 1, 3, 3A, 4, 4A, 5, 6, 6A, 6B, 8, 9, 10, 11A, B, and C, 12, and 13. The channel 26 extends from the apex end 16, which encloses and covers it, to the base end 18, where it extends completely through the base 18 to the outside. The air channel 26 at the third portion 24 of the core 14 will be the area or point of reception and installation of a cleaning system line 12, as shown by general schematic example at FIG. 6A.

The core 12 is also provided with an inner surface 28, adjacent to the channel 26; and an outer outboard surface 30, spaced dimensionally and positionally from the inner surface 28, and being the outside surfacing of the core 14, as illustrated by example in the drawings.

The apex end 16 and the first and second portions 20 and 22 of the core unit 14 have a number of air apertures 32 which extend through the outer and inner surfaces 30 and 28 and communicate and connect with the air channel 26. The apertures 32 are positionally arranged in a functional patterning throughout these areas (16, 20, 22, 30 and 28); and create, by virtue of their placement and patterning, a number of solid interstitial spaces 34 between the apertures 32, with such spacing occuring between each of the apertures 32.

The DAD 10 is further provided with a feathering system 36, or means, which is securely fixed and attached to the interstitial spaces 34 of the outboard surface 30. This feathering system 36 is dimensioned and positioned to create a selected configurational shape, discussed in detail later herein.

The DAD 10 is designed to be installed along the air channel 26 of the base end 18, at the third portion 24 of the core unit 14; in interaction and connection with a cleaning system line 12, as illustrated generally by example in FIG.

6A. The DAD 10, by virtue of its connection to a suction-type or blowing type vacuum or air source, functions in equalizing the suction or blowing area, presented to a work area, and existing by virtue of the structural advantages of the DAD 10 in a substantial improvement over the prior art; to produce such an equalization of surface air flow between the apex end 16 and the second portion 22, and its adjacent areas, of the core unit 14; while dislodging dirt, dust, particles, debris or like matter encountered at a work site or area.

Figure 14:
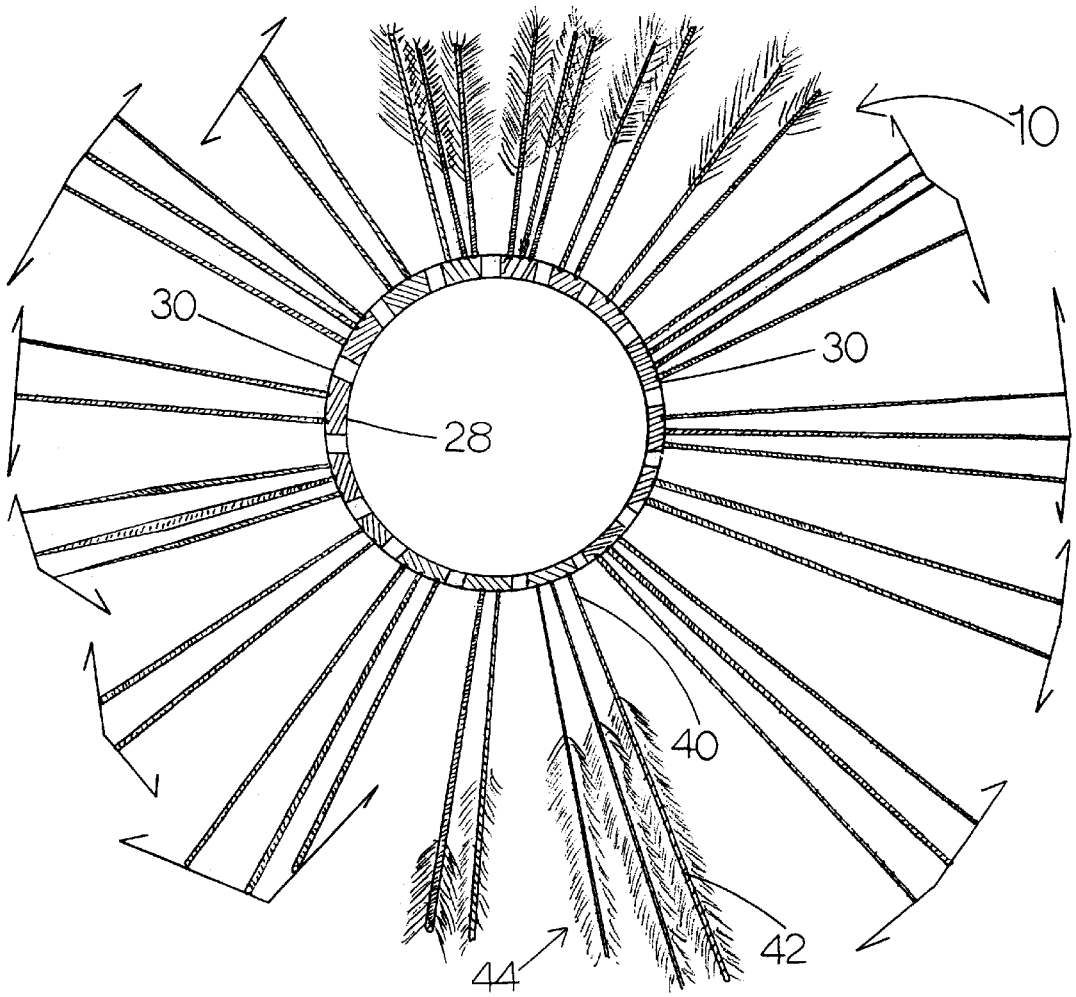
FIG. 14 is a partial angled cross-sectional width portion of a preferred embodiment of the invention, having a cone-type core unit.

In preferred embodiments of the DAD 10, of the present invention, the feathering system 36 is composed of, and comprises, a number (or plurality) of individual feather components 38. Additionally, in preferred embodiments, each individual feather component 38 is provided with a lower central quill portion 40, or central sheath stem component, a upper rachis portion 42, or upper central stem portion from which many or most of the balance of the feather emanate; and a vane portion 44 which constitutes the web feathering and balance of the individual feather 38 (that part normally the expanded or expandable width portions). Each of the portions 40, 42 and 44; illustrated in FIG. 14, by example; is fabricated, cut, dimensioned or otherwise adapted or positioned in accordance with the selected configurational shape of the feathering system 36 (described in detail herein), to be structurally supported and functionally utilized with, and as a part of, the core unit 14 of the DAD 10.

The feathering system 36 is designed to be of a substantially voluminous nature and to comprise individual feather components 38 which are structured or positioned to be flexible in nature in response to a work site or area, as opposed to the conventionally available solid or hard and generally inflexible or non-positionable feather or brush dusters with limited or less numbers of hard feathers or 'bristles;' and having no particular functional configurational shape.

In preferred embodiments, the lower central quill portions 40, and other portions 42 and/or 44, are, each securely fixed and attached to, and throughout, the solid interstitial spaces 34 between the air apertures 32; and are so attached on the outer surface 30 where the interstitial spaces 34 and apertures 32 are located. The feather components 38 are each attached separately at interstitial spaces 34 of the outer surface 30 of the apex end 16 and first and second portions 20 and 22 of the core 14; by a number of available cementing, holding and attachment means, including glues, cement, curable polymers or calks.

Also, in preferred embodiments of the DAD 10, the core unit 14 is provided in the configurational shape of a cone or truncated cone 46 structure; as illustrated, by example, in FIGS. 1, 2, 3, 3A, 38, 6A, 6B, 7, 8, 9, 10, 11A, 11B, 12, and 13. Within the configuration and shape of the cone 46, in preferred embodiments of the present invention, the core unit 14 is tapered, and narrows in perimeter or circumference from the base end 18 to the apex end 16.

The core unit 14 is also provided in a pyramidal or truncated configuration 48 (shape and structure), having three (3) or more pyramidal faces 50. In these related embodiments, the core 14 also tapers and narrows by virtue of the dimensioning and slope of each of the faces 50, from the base end 18 to the apex end 16. The apex end 16 takes the form in these related, preferred embodiments of a vertex end.

Also, in preferred embodiments, the air apertures 32 are arranged in a preselected or set pattern or patterning, as shown by example in FIGS. 1 through 13. In this regard, a preferred patterning is an alternating patterning 52, where one line, or a first line 54 of air apertures 32 is defined or presented as one number of apertures along a line, perimeter or circumference, or area spacing thereof; and the upper adjacent line 56 of apertures 32, relative to the first line 54, is defined as a number of apertures 32 less in number than that of the first line 54; and, in this regard, the lower adjacent line 58, relative to the first line 54, is also composed of a number of apertures less in number than that of the first line 52. This teaching of the present invention is illustrated by example in FIGS. 1, 2, 3, 3A–C, 4, 4A, 4B, 5, 8, 9, and other drawings herein. Each of the lines of air apertures 54, 56, and 58, of the alternating patterning 52, are generally parallel in positioning to one another; or, generally, equally spaced from one another and extending in substantially the same direction in relation to one another. Another related preferred embodiment to patterning 52 is the space-slot patterning 60, shown by example in FIG. 7, where alternating lines of apertures 62 are generally parallel and evenly spaced in positional relation the or orientation to one another; and each line is provided with the same number of air apertures 32. Further, in the space-slot patterning of apertures 60, each aperture is also offset, or in a slot or space different from apertures in the line 62 above or below a given line 62 so that an imaginary, substantially triangular positional orientation 64 is created positionally between adjacent apertures 32 on adjacent, neighboring lines 62, as shown by example in FIG. 7.

The air apertures 32, themselves, in all of the preferred embodiments of the invention, herein and within the scope of the invention, are provided in shapes which are circular, elliptical, triangular, square, arcuate, diamond-shaped (equilateral parallelogram-rhombus), rhomboid, parabolic, parallelogram-like, trapezium-like or trapezoid; where all of the apertures 32 are of the same substantial shape or where the apertures 32 utilized in the core unit 14 are of different or mixed configurations of those listed above. Also, the apertures 32 can be dimensioned generally equally or consistently, in dimensional scale, or can be a mixture of different dimensioning or scaling. In this regard, a preferred general range of general widthwise or lengthwise dimensioning is from about 0.120 inches (or about 3 mm.) to about 0.250 inches (or about 6.3 mm.), with a preferred optimal or functional mid-range dimensioning being about 0.147 inches (or about 3.7 to 3.8 mm.).

The preferred functional dimensioning of each of the individual feather components 38 is from about 0.008 inches (or about 0.4–0.5 mm.) to about 0.066 inches (or about 1.6–1.8 mm.) in the diameter or width of the lower central quill portion 40, with a functionally optimal or mid-range diameter or width being about 0.017 inches (or about 0.3–0.5 mm.); from about 0.004 inches to about 0.015 inches in the diameter or width of the upper rachis portion 42, with a functionally optimal or mid-range diameter or width being about 0.007 inches; and from about 0.313 inches to about 0.680 inches at the widest span or dimensional breath of the vane portion 44, in a non-compressed or non-crushed state, with a functionally optimal or mid-range dimension being about 0.521 inches.

It will be understood, within the scope of the invention, that other dimensioning; greater, smaller or equivalent; can be utilized with respect to the air apertures 32 and the feather components 38; and that the dimensioning referenced herein, above, is set forth to provide some of the exemplar, preferred embodiments of the invention, and not by way of limitation of the breath, scope and spirit of the present invention.

The feathering system 36 is provided, as to preferred embodiments of the DAD 10, in selected preferred, functional and configurational shapes; as illustrated generally, by example, in FIGS. 1, 3, 5, 8, 9, 10, 11A, 11B, 12 and 13.

Figure 3:
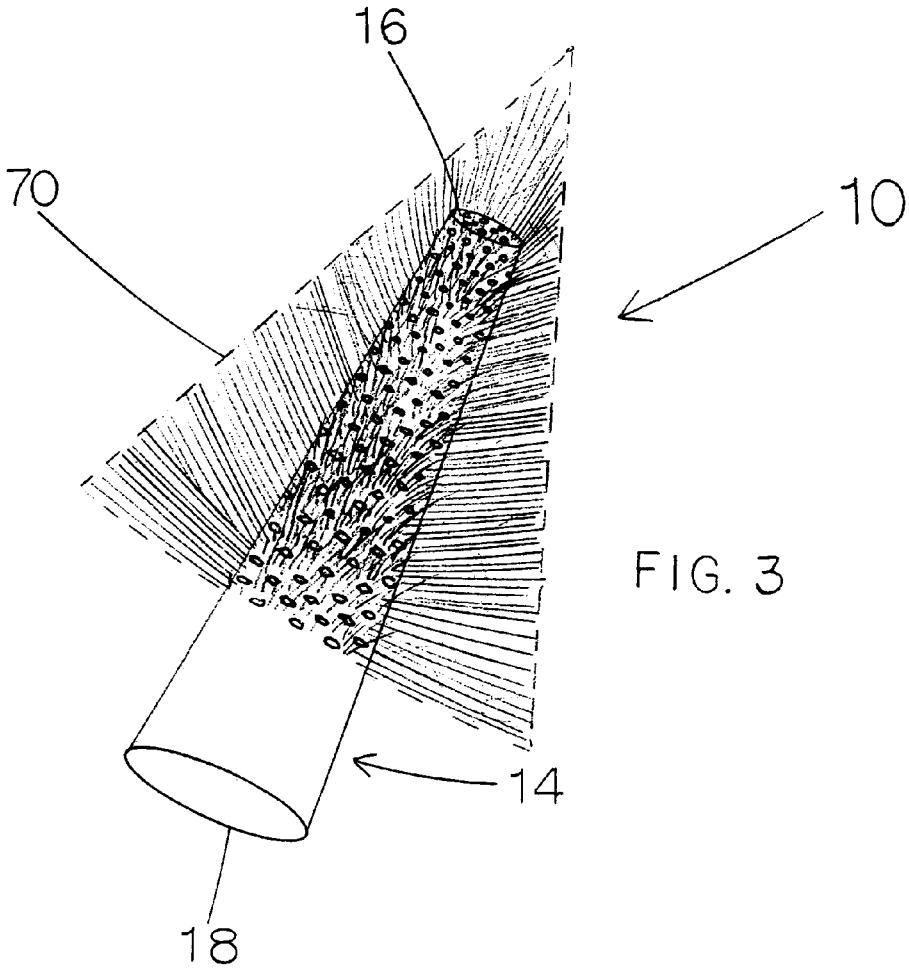
FIG. 3 is a perspective view of another preferred embodiment of the present invention.
Figure 3C:
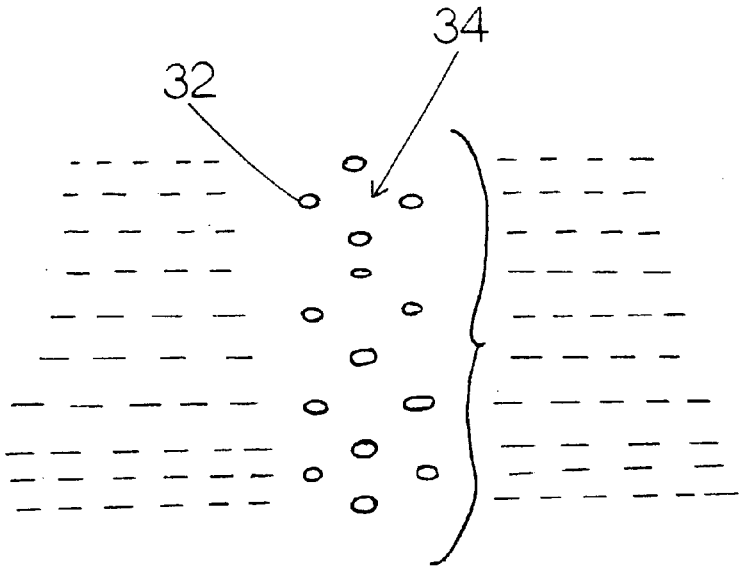
FIG. 3C is a partial schematic representation of a selected air aperture patterning of a preferred embodiment of the invention.
Figure 3A:
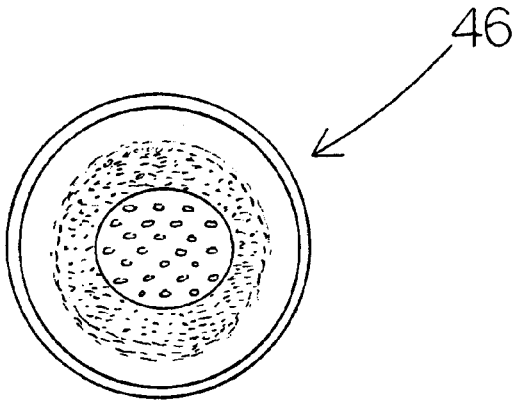
FIG. 3A is a bottom view of the core unit of the invention of FIG. 3, shown without the feathering system of the invention.
Figure 3B:
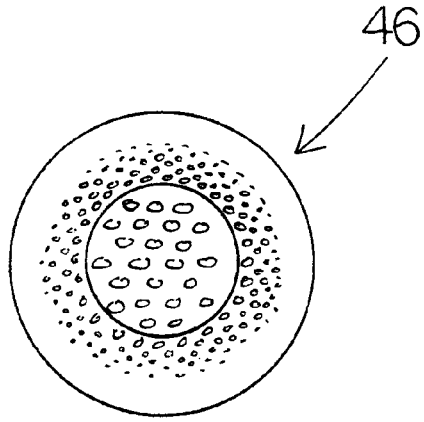
FIG. 3B is a top view of the core unit of the invention of FIG. 3, shown without the feathering system of the invention.
Figure 4A:
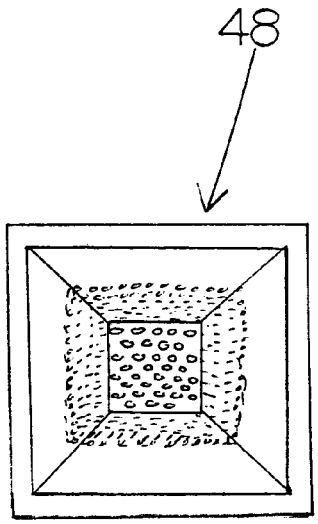
FIG. 4A is a bottom view of the core unit of the invention of FIG. 4.
Figure 4B:
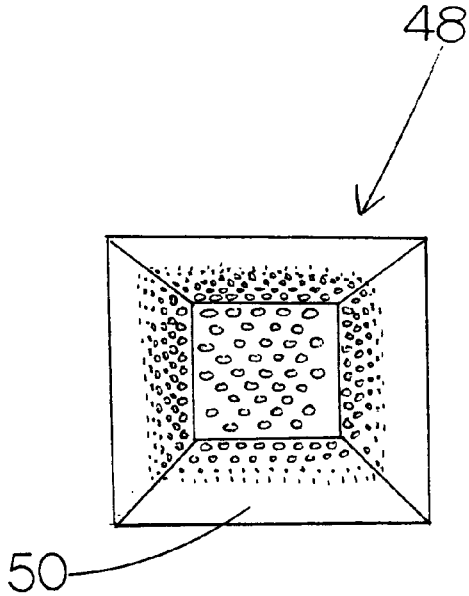
FIG. 4B is a top view of the core unit of the invention of FIG. 4.
Figure 4:
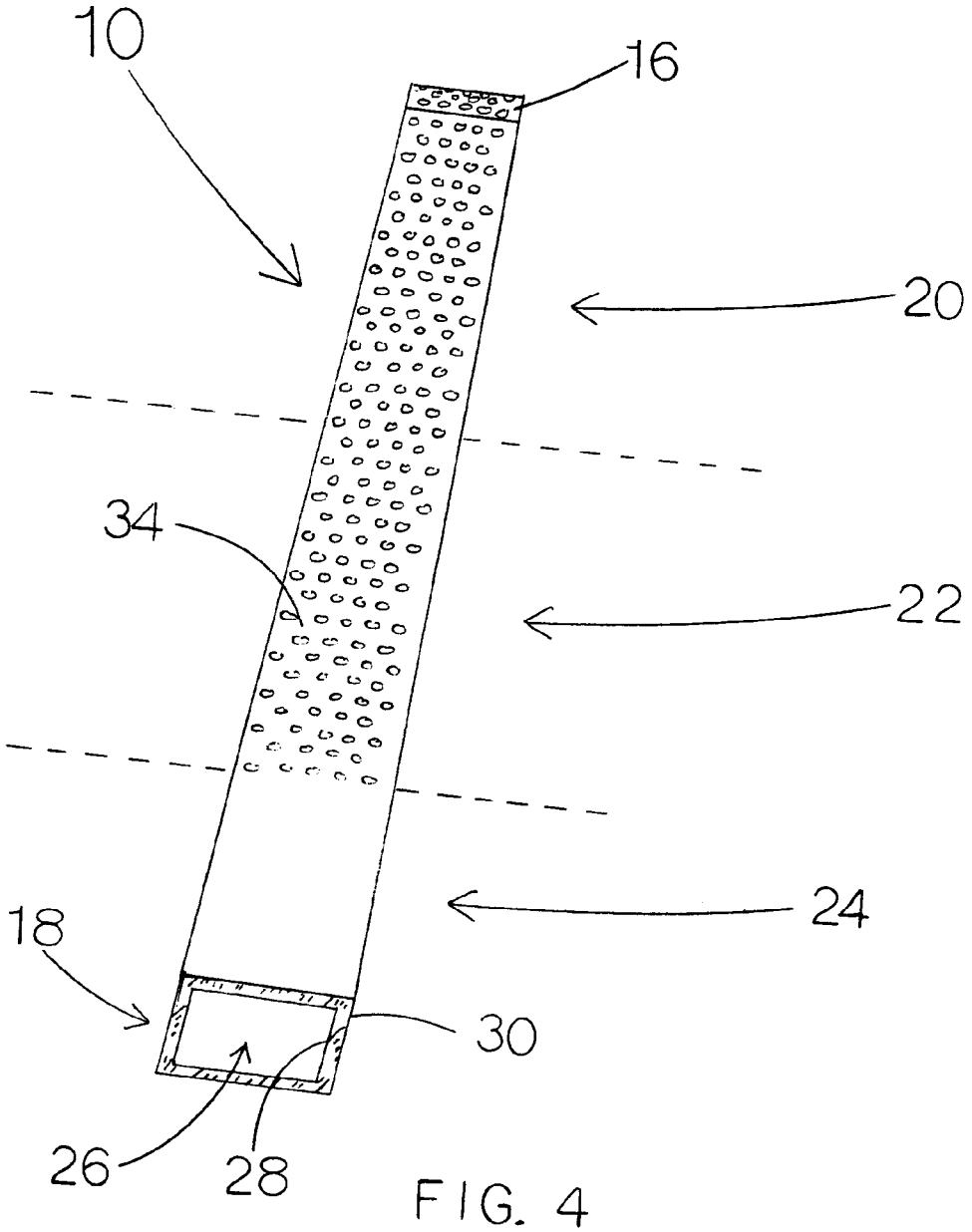
FIG. 4 is a perspective view of another embodiment of the core unit of the present invention.
Figure 5:
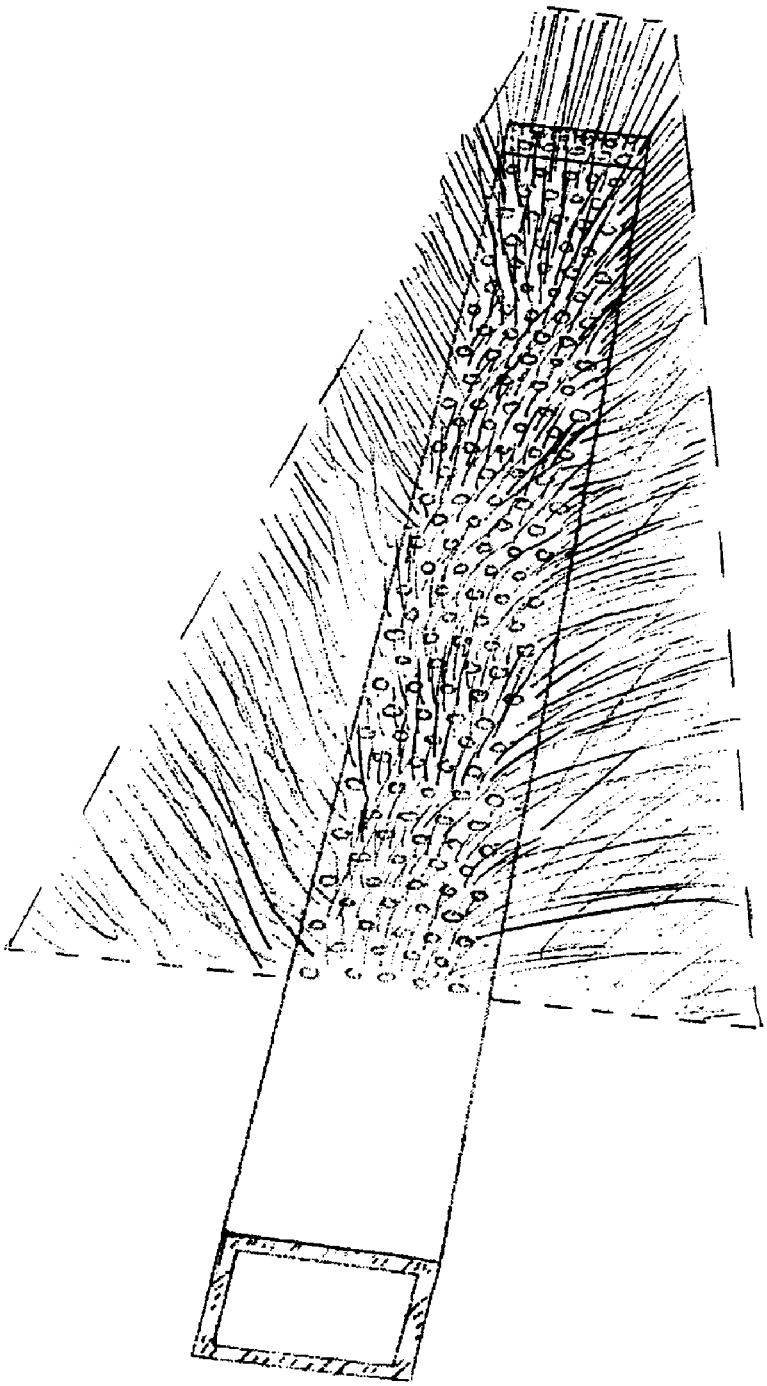
FIG. 5 is a perspective view of another preferred embodiment of the present invention.
Figure 6A:
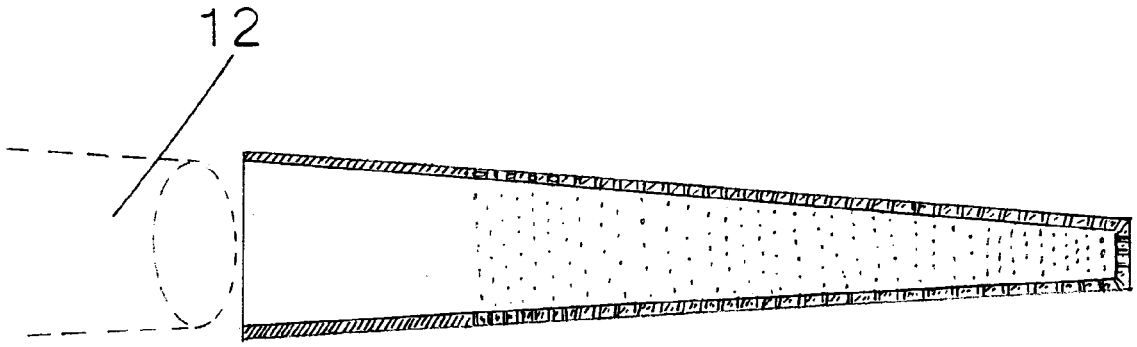
FIG. 6A is a lengthwise cross-sectional view of the core unit of the present invention, illustrated in FIGS. 3A and 3B.
Figure 6B:
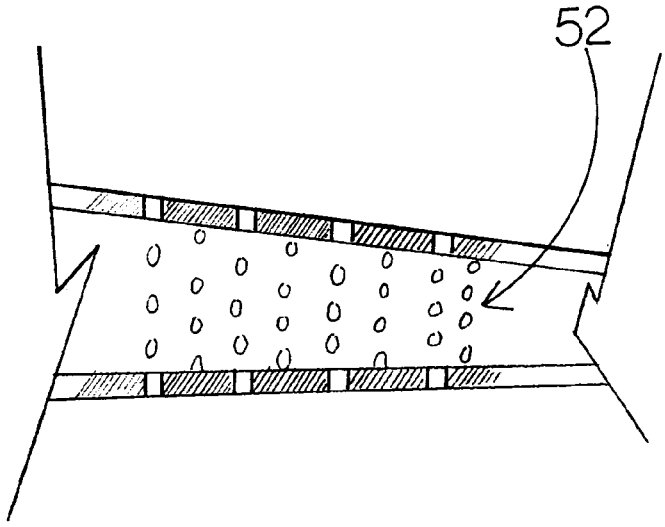
FIG. 6B is an enlarged partial view of a portion of the cross-section view of FIG. 6A, to show greater detail thereof.
Figure 7:
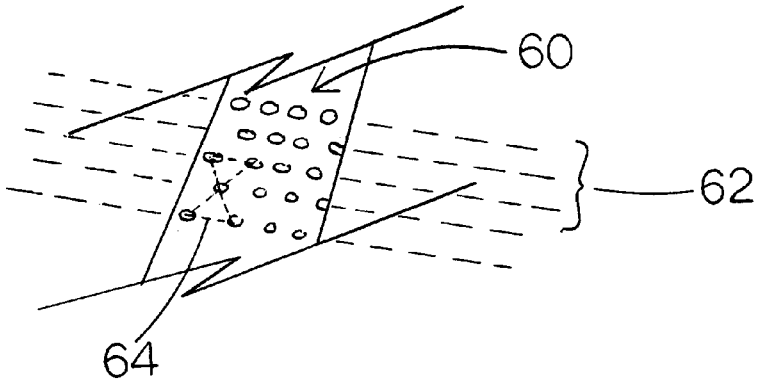
FIG. 7 is a partial view of an air aperture patterning of a preferred embodiment of the present invention.
Figure 8:
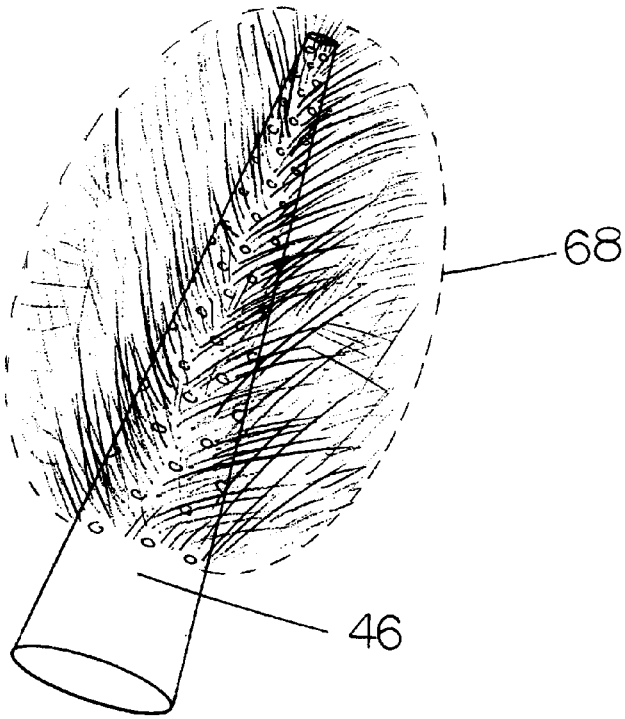
FIG. 8 is a perspective view of another preferred embodiment of the invention.
Figure 9:
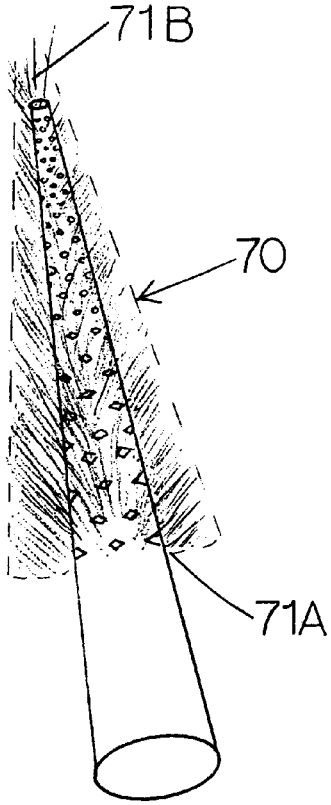
FIG. 9 is a perspective view of another preferred embodiment of the invention.
Figure 10:
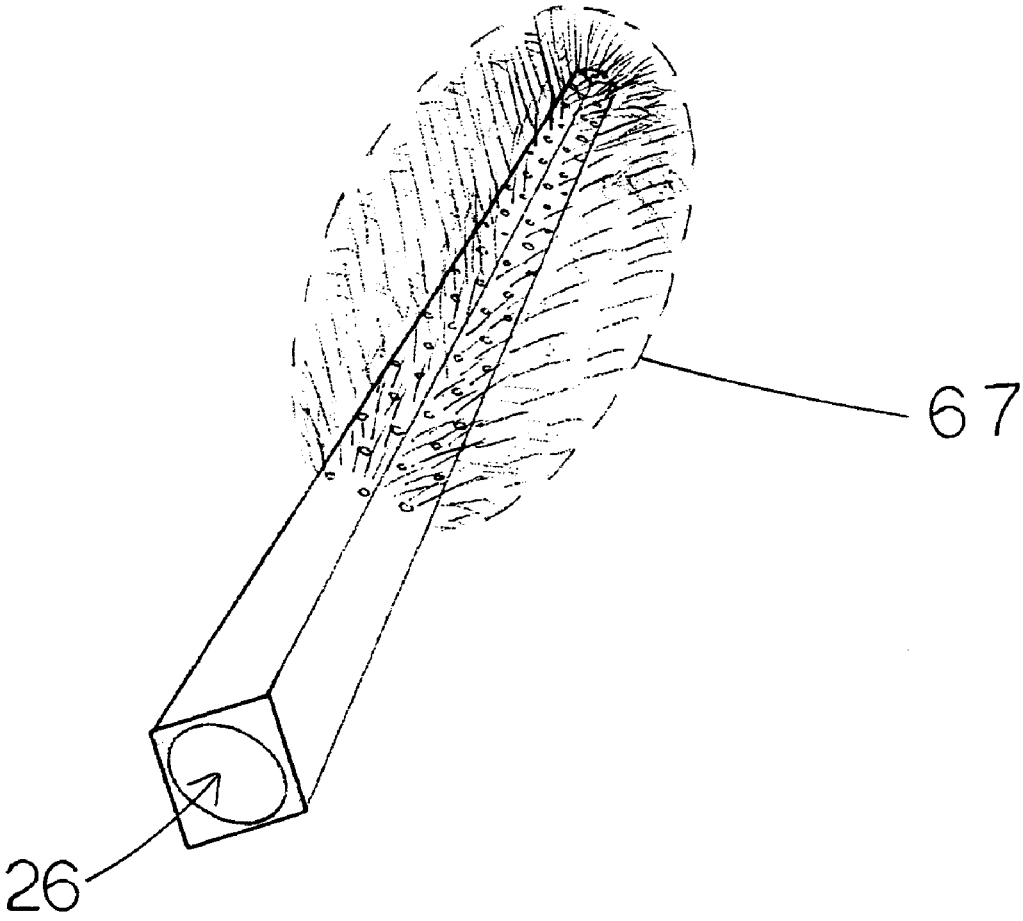
FIG. 10 is a perspective view of another preferred embodiment of the invention.
Figure 13:
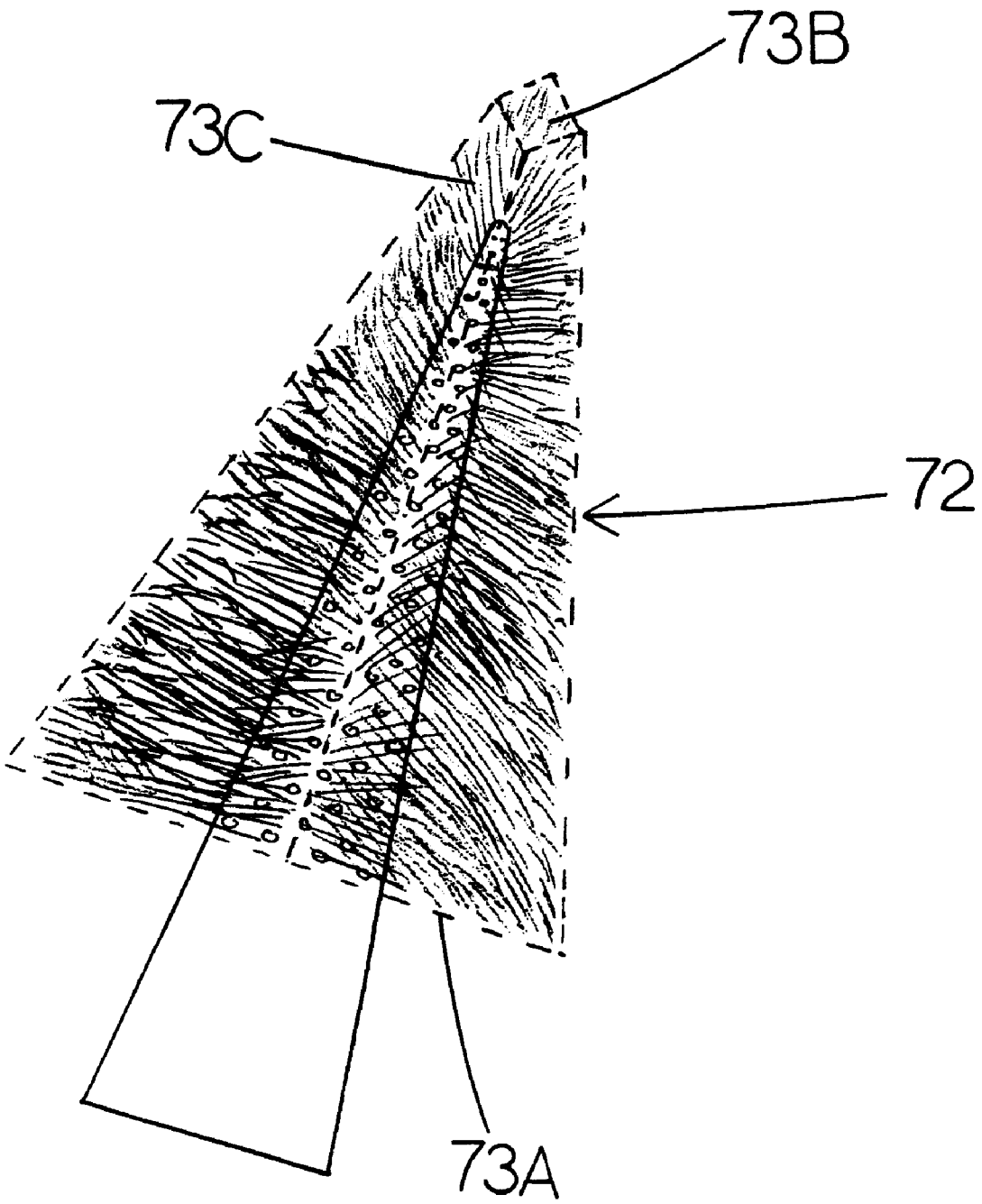
FIG. 13 is a top view of another preferred embodiment of the present invention.

In this regard, the feathering system 36 is provided in a generally circular configuration and contour 66, as illustrated in FIG. 1; a generally arcuate configuration 67, as illustrated in FIG. 10; a generally elliptical configuration and contour 68, as illustrated in FIG. 8; a generally conical or frustum-cone configuration and contour 70 (or Christmas tree-like shape), as illustrated in FIGS. 3 and 9, having the base portion 71A which tapers to the apex portion 71B; and a generally pyramidal or frustum-pyramid-like configuration and contour 72, as illustrated in FIG. 13, having the base portion 73A which tapers to the vertex portion 73B, and where the pyramidal configuration 72 of feathering 36 is provided with three (3) or more pyramidally planed face portions 73C.

Figure 11A:
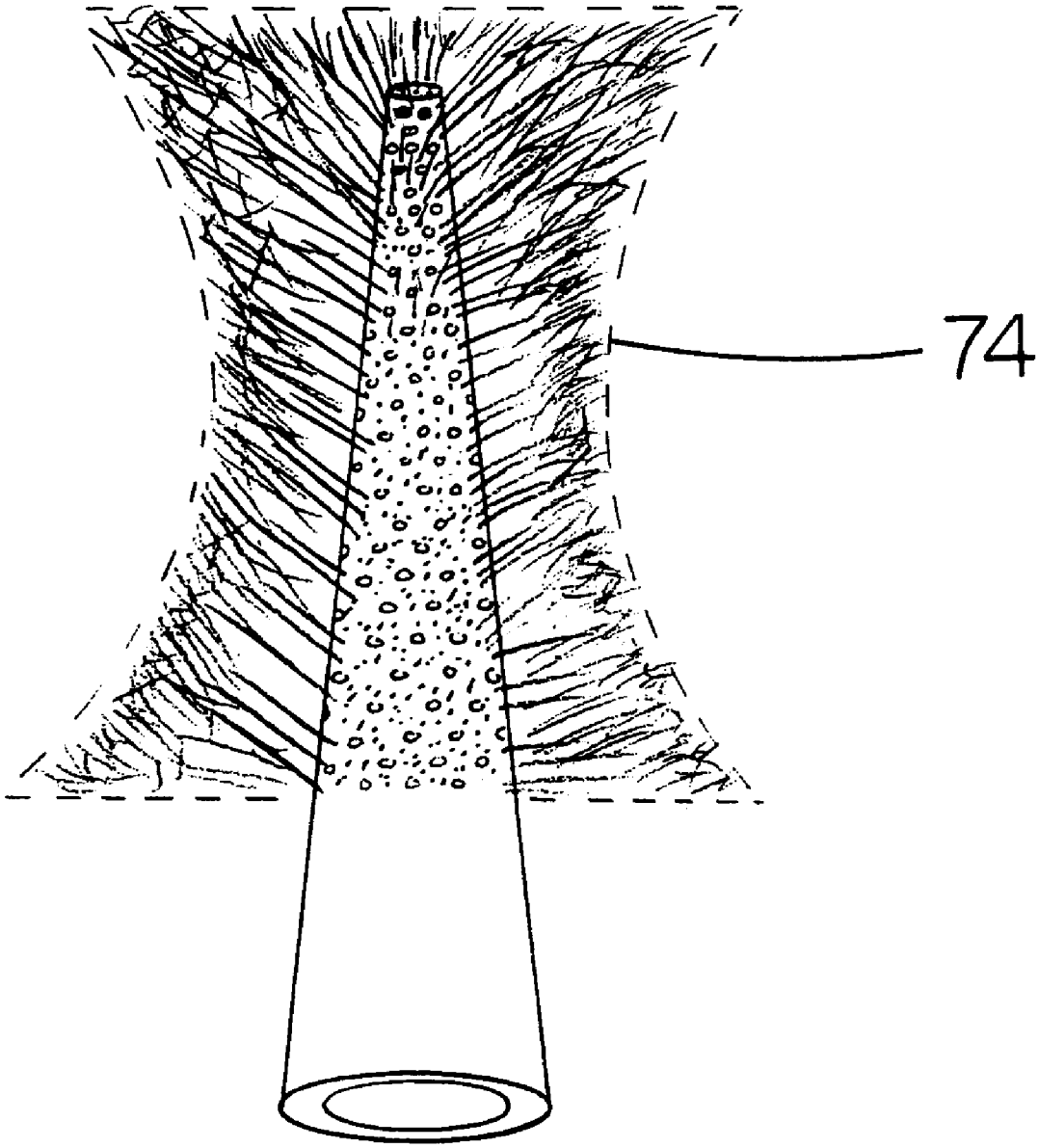
FIG. 11A is a perspective view of another preferred embodiment of the present invention.
Figure 11B:
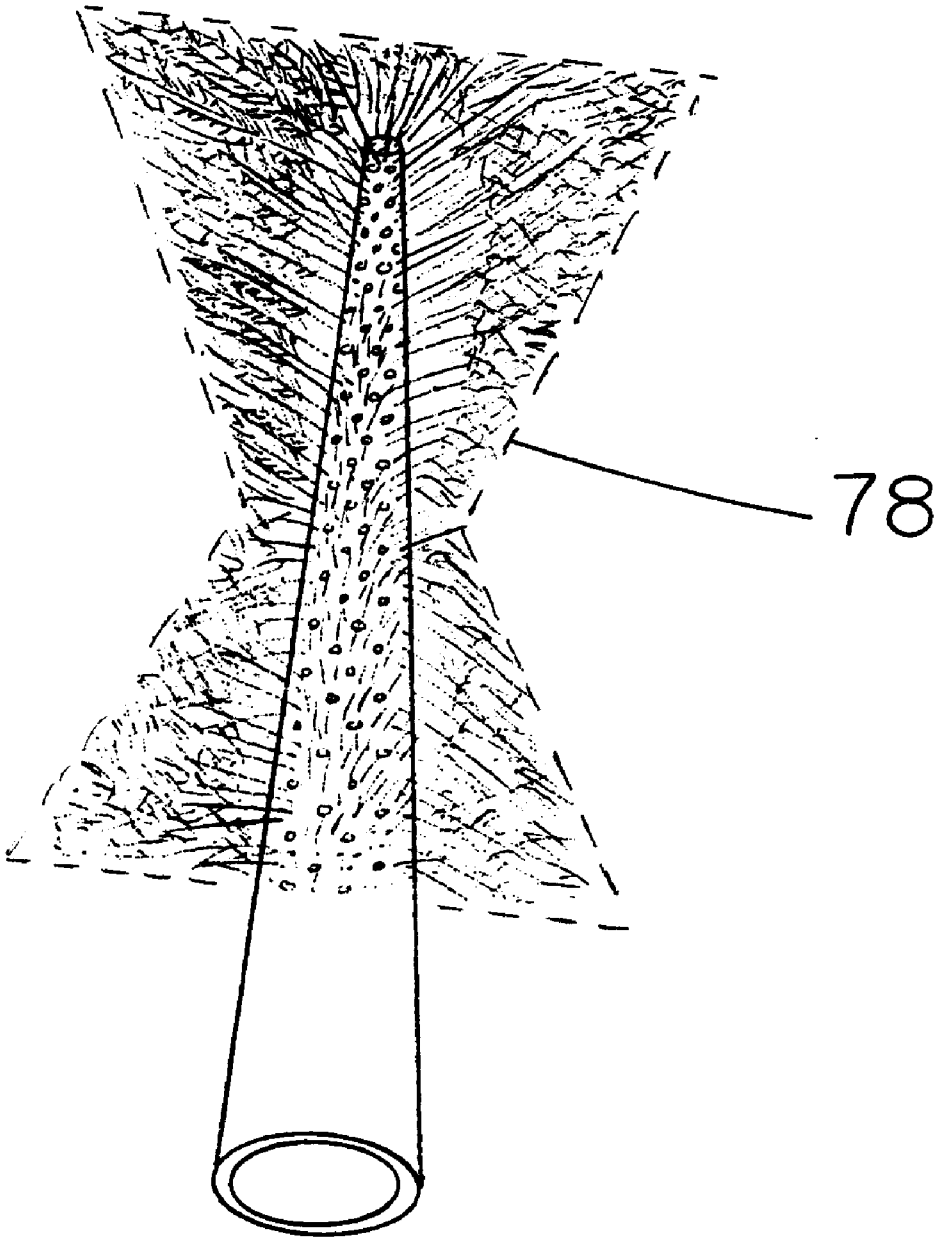
FIG. 11B is a perspective view of another preferred embodiment of the invention, related to the embodiment of FIG. 11A.
Figure 12:
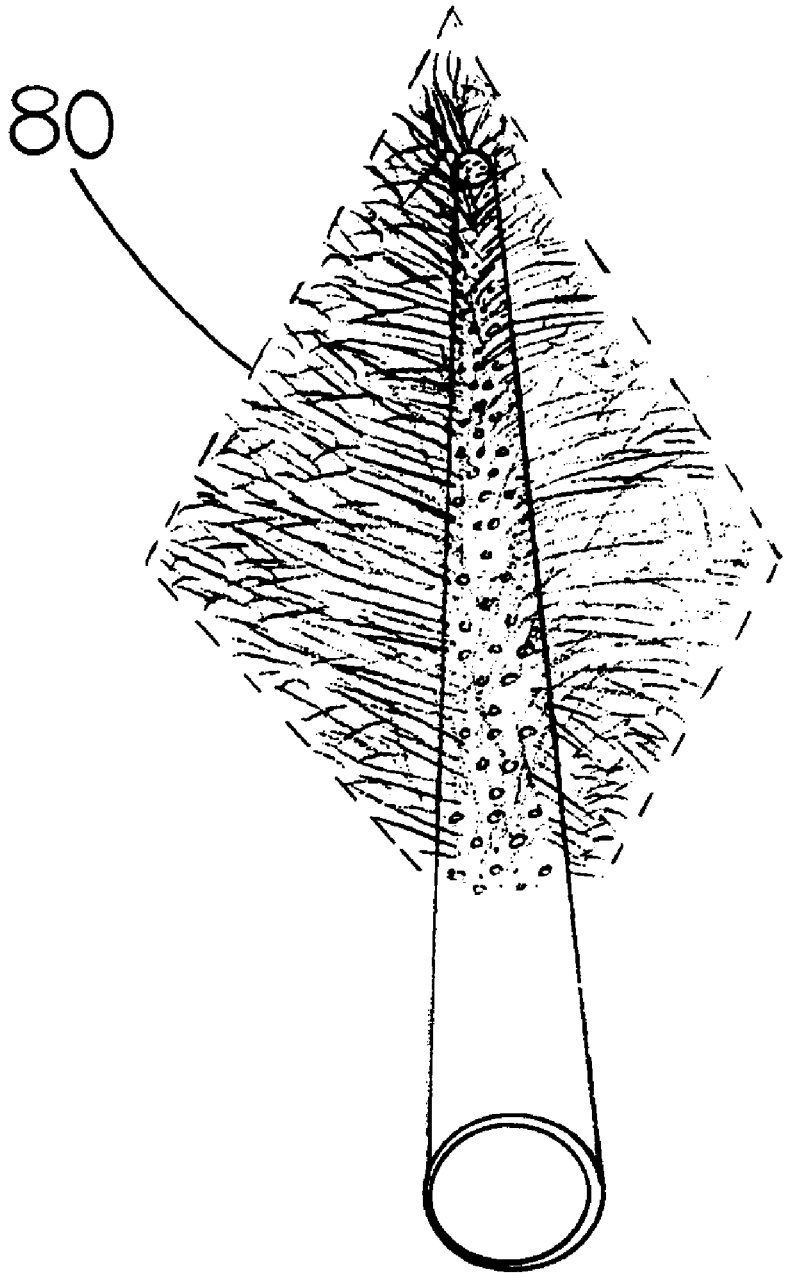
FIG. 12 is a perspective view of another preferred embodiment of the invention.

Additionally, the feathering system 36 is provided in preferred embodiments of the invention in a generally curved reverse-tapered configuration 74, as illustrated by example in FIG. 11A; a generally linear (or straight-lined) reverse-tapered configuration 78, as illustrated by example in FIG. 11B; and a generally rhombus-like (equilateral parallelogram or diamond-like) reverse-taper configuration 80, as illustrated in FIG. 12.

Each of the configurations discussed herein; 66, 67, 68, 70, 72, 74, 78 and 80; and their equivalent within the scope and spirit of the invention; are comprised of individual feather components 38 which are each, respectively, dimensioned, as within the preferable dimensional range discussed earlier, by example; fabricated; cut or trimmed, in the case of soft natural avian (or bird) feathers; and positioned and attached by their lower central quill portion 40, or other available portions 42 and/or 44, at the solid interstitial spaces 34 of the core unit 14. Each is so positioned and attached, as fabricated and dimensioned, to constitute structurally, and by design, part of the overall configuration (66, 67, 68, 70, 72, 74, 78, 80 or equivalents thereof).

Additionally, in preferred embodiments, the base end 18 is provided with a general diameter or width dimension of from about 1.010 inches to about 1.120 inches, or from about 25.4 mm. to about 28.5 mm., when in a circular configuration; and a dimension along each of two focus points (or diameter-like line or plane) of from about 1.470 inches to about 1.6 inches, or from about 37.2 mm. to about 40.7 mm., when in an elliptical configuration. The apex end 16 is provided in a diameter or a dimension at its longest span, of from about 0.5 inches to about 0.6 inches, or from about 12.7 mm. to about 15.5 mm.; or in like scale in accordance with a conical or pyramidal, core unit 14. In each case the core unit 14 is preferably fabricated from a flexible or malleable, or soft metal, metal alloy, plastic, polymer, or fabric having positional integrity; while still being substantially heat resistant; so that the core unit 14, as fabricated, is bendable, flexible or formable by reasonable human pressure to a desired position, while still remaining biasable or pressure stable, and heat tolerant, at a given area such as the base end 18, as installed.

The dimensions set forth above further elucidate a mathematical ratio between the base end 18 and the apex end 16; within the scope and spirit of the invention; as well as a mathematical relationship or ratio as to other elements of the invention dimensionally described herein. Other factors and elements contributing to the function and utility of the present invention include the special selected air aperture patternings described herein; and the selected configurations and contours of the feathering system 36 described herein; each facilitating air flow equalization of the core unit 14 in relation to an air source of a cleaning system (12), and with respect to the invention's ability to better provided a positionally oriented dusting surface which interfaces between a work site (or dusting surface) and the air apertures 32 of the core unit 14.

It will be understood, however, that it is within the scope and spirit of the present invention to provide other types of air aperture patternings, size and shape of air apertures 32, and size and configuration of feathering systems 36.

Accordingly, the appended claims are intended to cover all changes, modifications and alternative options and embodiments falling within the true breath, scope and spirit of the present invention. The reader is, therefore, requested to determine the scope of the invention by the appended claims and their legal equivalents, and not by the examples which have been given.

What is claimed is:

1. A dusting attachment device for use in interaction with a cleaning system having a suction or blowing means and a line or extended line in communication therewith, said dusting attachment device comprising:

a core unit having an apertured apex end, an open base end and first, second and third lengthwise-oriented portions disposed therebetween, respectively, from said apertured apex end to said open base end, the core unit defining therewithin an air channel extending from within the apertured apex end to the open base end, the apertured apex end and the first, second and third lengthwise-oriented portions having and defining an inner surface adjacent to the air channel and an outer surface being the outermost surface of the core unit, the apertured apex end and the first and second lengthwise-oriented portions of said core unit further defining, in a patterning throughout, a plurality of air apertures, extending between the outer and inner surfaces, and defining a number of solid interstitial space portions between each of said air apertures; and feathering means being fixedly attached to the solid interstitial space portions of the apertured apex end and the first and second lengthwise-oriented portions of said core unit, at the outer surface thereof, the feathering means defining a selected configurational shape;

whereby, said dusting attachment device can be installed along the air channel of the base end, at the third lengthwise-oriented portion, of said core unit, in interaction with a line in communication with a suction or blowing means of a cleaning system, for functional use in equalizing the suction or blowing area between the apertured apex end, the second lengthwise-oriented portion and adjacent areas of said core unit, while dislodging dirt, dust, particles, debris and like matter in a work area.

2. The dusting attachment device of claim 1, wherein:

the feathering means comprises a plurality of individual feather components, each individual feather component having a lower central quill portion, an upper rachis portion and a vane portion, the plurality of individual feather components each being dimensioned in accordance with the selected configurational shape.

3. The dusting attachment device of claim 2, wherein:

the lower central quill portion of each of the plurality of individual feather components is fixedly attached to, and throughout, the solid interstitial space portions.

4. The dusting attachment device of claim 3, wherein:

the core unit is in the configuration of a cone, tapering in shape from the open base end to the apertured apex end.

5. The dusting attachment device of claim 3, wherein:

the core unit is in the configuration of a pyramid, having a plurality of face-walls sloping from the open base end to the apertured apex end.

6. The dusting attachment device of claim 3, wherein:

the plurality of air apertures comprises, and is substantially arranged in, a set patterning of individual air apertures.

7. The dusting attachment device of claim 6, wherein:

the set patterning of individual air apertures further comprises a number of generally, adjoining parallel and spaced lines of individual air apertures, wherein, a first of the lines of individual air apertures comprises a selected number of air apertures and an adjoining parallel line therewithin comprises a lesser number of air apertures than that of the first of such lines.

8. The dusting attachment device of claim 3, wherein:

the configurational shape of the feathering means is substantially circular in contour.

9. The dusting attachment device of claim 3, wherein:

the configurational shape of the feathering means is substantially arcuate in contour.

10. The dusting attachment device of claim 3, wherein:

the configurational shape of the feathering means is substantially elliptical in contour.

11. The dusting attachment device of claim 3, wherein:

the configurational shape of the feathering means is substantially conical in contour, defining an apex portion proximate to the apertured apex end of said core unit and a base portion proximal or adjacent to the second lengthwise-oriented portion of said core unit, and further defining a tapered perimeter from said base portion to said apex portion thereof.

12. The dusting attachment device of claim 3, wherein:

the configurational shape of the feathering means is substantially pyramid-like in contour, defining a vertex portion proximate to the apertured apex end of said core unit and a base end proximal to the second lengthwise-oriented portion of said core unit, the base end extending along a tapered and pyramidally faced perimeter, to the vertex portion.

13. The dusting attachment device of claim 3, wherein:

the configurational shape of the feathering means has a reverse-tapered contour.

14. The dusting attachment device of claim 13, wherein:

the reverse-tapered contour comprises a first base portion, a second base portion and a middle portion between said first and second base portions, the first and second base portions, each having a tapering perimeter sloping toward, and connecting with, the middle portion of said reverse-tapered contour.

15. The dusting attachment device of claim 13, wherein:

the reverse-tapered contour comprises a first apex portion, a second apex portion and a middle portion between said first and second apex portions, the first apex portion being oppositely positioned from, and positionally opposing, the second apex portion, the middle portion having a first perimeter section tapering and sloping toward, and connecting with, the first apex portion, and a second perimeter section tapering and sloping toward, and connecting with, the second apex portion.

16. The dusting attachment device of claim 3, wherein:

the lower central quill portion is dimensioned to a diameter or width of from about 0.088 inches to about 0.066 inches, the upper rachis portion is dimensioned to a diameter or width of from about 0.004 inches to about 0.015 inches, and the vane portion is dimensioned to from about 0.313 inches to about 0.680 inches at its widest span or dimensional breath, in a non-compressed or non-crushed positional state.

17. The dusting attachment device of claim 3, wherein:

the core unit is fabricated or constructed from a malleable, formable and positionable material, chosen from a group of substances including tin, aluminum, metal, metal alloy, plastic, polymer, composite materials, and formable mesh or porous netting, and formable, position stable fabric, each having position integrity and biasing force as positioned.

18. A vacuum dusting attachment device for use in interaction with hose or communication line of a vacuum cleaning apparatus, said vacuum dusting attachment device comprising:

a core unit having a generally enclosed, apex end and a substantially open and hollow, base end and first, second and third lengthwise-oriented portions positioned therebetween, respectively, between said apex end and said base end, the core unit defining therewithin an air channel extending from the apex end to the base end, and defining and having an inner surface adjacent-most to the air channel and an outer surface being and positioned as the outermost surface of the apex end and the first, second and third lengthwise-oriented portions thereof, the apex end and the first and second lengthwise-oriented portions of said core unit further defining, in a patterning throughout, a plurality of air apertures, extending through the outer surface thereof and the inner surface, and defining a number of interstitial space portions, each, positioned between each of said air apertures on the apex end and on each of said first and second lengthwise-oriented portions, the core unit being substantially in the configuration of a cone, tapering in shape from the base end to the apex end thereof; and feathering means comprising a plurality of individual feather components, each feather component comprising a central shaft portion, having, at least, first and second ends, and a vane portion, each of the feather components being attached, at their respective first end of their central shaft portion, to the interstitial space portions of the outer surface of the apex end and the first and second lengthwise-oriented portions of said core unit, and dimensioned to define a generally geometric configuration.

19. A vacuum dusting attachment device, comprising:

a hollow core unit having a lengthwise, peripheral wall portion and first and second ends, the peripheral wall portion having an outer wall surface portion and defining a widthwise thickness, said peripheral wall portion defining a number of air apertures extending completely through the widthwise thickness, thereof, and further defining a number of solid interstitial space portions between the air apertures and positioned on the outer wall surface portion thereof; and feathering means comprising a plurality of individual feather components, each of the feather components being fixedly attached to the solid interstitial space portions so as to extend above the air apertures of the peripheral wall portion.

20. The vacuum dusting attachment device of claim 19, wherein:

the first end has an outer surface and an inner surface, and defines a number of air apertures extending therethrough, and further defines a number of solid interstitial spaces, on the outer surface thereof, between the numbers of air apertures of said first end; and wherein:

the feathering means comprises a further plurality of individual feather components, each of the further plurality of individual feather components being fixedly attached to the solid numbers of interstitial spaces of the first end so as to extend above the number of air apertures thereof.

* * * * *